US010349711B2

(12) United States Patent
Chiang

(10) Patent No.: US 10,349,711 B2
(45) Date of Patent: Jul. 16, 2019

(54) EXTENDABLE LUGGAGE

(71) Applicant: C & C LUGGAGE MANUFACTURING CO., LTD., Guangdong (CN)

(72) Inventor: Hsi-Wu Chiang, Guangdong (CN)

(73) Assignee: C & C Luggage Manufacturing Co., Ltd., Guangdong (CN)

( * ) Notice: Subject to any disclaimer, the term of this patent is extended or adjusted under 35 U.S.C. 154(b) by 119 days.

(21) Appl. No.: 15/461,083

(22) Filed: Mar. 16, 2017

(65) Prior Publication Data

US 2018/0263347 A1 Sep. 20, 2018

(51) Int. Cl.

| | |
|---|---|
| ***E05B 65/52*** | (2006.01) |
| ***A45C 7/00*** | (2006.01) |
| ***A45C 5/03*** | (2006.01) |
| ***A45C 13/10*** | (2006.01) |
| ***A44B 19/30*** | (2006.01) |
| ***A44B 19/34*** | (2006.01) |

(52) U.S. Cl.

CPC ..... *A45C 7/0027* (2013.01); *A44B 19/30* (2013.01); *A44B 19/34* (2013.01); *A45C 5/03* (2013.01); *A45C 13/103* (2013.01); *A45C 2005/037* (2013.01)

(58) Field of Classification Search

CPC ..... A45C 7/0022; A45C 5/14; A45C 7/0063; A45C 7/0031; A45C 7/0027

USPC ..... 190/103, 100, 18 A, 14

See application file for complete search history.

(56) References Cited

U.S. PATENT DOCUMENTS

| | | | | |
|---|---|---|---|---|
| 5,671,831 | A * | 9/1997 | Chiu | A45C 5/14 190/103 |
| 5,875,876 | A * | 3/1999 | Wang | A45C 5/14 150/111 |
| 6,220,411 | B1 * | 4/2001 | Scicluna | A45C 7/0031 190/103 |
| 6,390,259 | B1 * | 5/2002 | Lu | A45C 7/0022 190/103 |
| 6,408,997 | B1 * | 6/2002 | Chen | A45C 5/14 190/103 |
| 8,967,375 | B1 * | 3/2015 | Nitkin | A63C 11/025 206/315.2 |
| 9,357,821 | B1 * | 6/2016 | Montoya | A45C 9/00 |
| 9,706,822 | B2 * | 7/2017 | Tseng | A45C 5/14 |
| 9,826,808 | B2 * | 11/2017 | Yeh | A45C 5/03 |
| 9,894,970 | B2 * | 2/2018 | Sheikh | A45C 5/06 |

(Continued)

*Primary Examiner* — Fenn C Mathew
*Assistant Examiner* — Cynthia F Collado
(74) *Attorney, Agent, or Firm* — Muncy, Geissler, Olds & Lowe, P.C.

(57) ABSTRACT

An extendable luggage comprises a first shell having a first opening edge, a second shell having a second opening edge, an inner zipper, an outer zipper and an inner strap. The inner zipper has outer teeth located at a first and second distance away from the first and second opening edge, respectively. The outer zipper has two outer tapes and outer teeth. Each outer tape has a straight section, a head section and a tail section. The outer teeth located at distal ends of the two head sections and two tail sections are closed and unable to be opened. The outer teeth located at the two straight sections are located at a third distance away from the first opening edge and a fourth distance away from the second opening edge. The inner strap is connected with two ends of the inner zipper. The luggage looks simple and is extendable.

11 Claims, 9 Drawing Sheets

(56) References Cited

U.S. PATENT DOCUMENTS

| | | | | |
|---|---|---|---|---|
| 2002/0148743 | A1* | 10/2002 | Tong | A45C 3/00<br>206/288 |
| 2002/0185350 | A1* | 12/2002 | Chang | A45C 5/02<br>190/105 |
| 2015/0034440 | A1* | 2/2015 | Lai | A45C 7/0027<br>190/103 |
| 2017/0127782 | A1* | 5/2017 | Korey | A45C 5/03 |

* cited by examiner

EXTENDABLE LUGGAGE

BACKGROUND OF THE INVENTION

1. Field of the Invention

The present invention relates generally to luggage and more particularly, to an extendable luggage.

2. Description of the Related Art

There are lots of luggage with different types in the market. In order to reduce a chance that the loaded goods are damaged, a customer may purchase a hard shell luggage with drop-resistance and collision-resistance. Furthermore, part of hard shell luggage not only has a hard shell design but also an extendable design, so as to extend a certain accommodating space. A conventional extendable luggage may has two zippers, a user opens one of which to open two shells and opens the other one of which to extend an accommodating space. However, no matter whether the user want use the extended function, the two zippers are exposed, so that the luggage looks complex but not simple. Therefore, the conventional extendable luggage do not have a simple looking design.

SUMMARY OF THE INVENTION

The present invention has been accomplished in view of the above-noted circumstances. It is an objective of the present invention to provide an extendable luggage, which is adapted for a hard shell, looks simple and is convenient for being operated, and an accommodating space thereof is extendable.

To attain the above objective, the present invention provides an extendable luggage, which comprises a first shell, a second shell, an inner zipper, an outer zipper and an inner strap. The first shell has a first opening edge. The second shell has a second opening edge. The inner zipper has two inner tapes respectively disposed at the first and second opening edges, a plurality of inner teeth disposed at the two inner tapes, at least one inner slider disposed at the inner teeth, and at least one inner puller disposed at the inner slider. The inner slider being used for opening or closing the opposite inner teeth. The inner teeth are located at a first distance away from the first opening edge and a second distance away from the second opening edge. The outer zipper has two outer tapes, a plurality of outer teeth disposed at the two outer tapes, at least one outer slider disposed at the outer teeth, and at least one outer puller disposed at the outer slider. The outer slider is used for opening or closing the opposite outer teeth. Each of the outer tapes has a straight section, a head section extended from an end of the straight section and not parallel to the straight section, and a tail section extended from the other end of the straight section and not parallel to the straight section. The two straight sections are respectively disposed at the first and second opening edges. The outer teeth located at distal ends of the two head sections and two tail sections are closed and unable to be opened. The outer teeth located at the two straight sections are located at a third distance away from the first opening edge, the outer teeth located at the two straight sections are located at a fourth distance away from the second opening edge, the third distance is less than the first distance, and the fourth distance is less than the second distance. The outer zipper is located at outside of the inner zipper. Two sides of the inner strap are respectively connected with the first and second opening edges. The inner strap is connected with two ends of the inner zipper, so that the inner zipper and the inner strap form a complete round.

Accordingly, a user can open or close the luggage or extend an accommodating space of the luggage easily depending on his/her demand. When the user need not to extend the luggage, the luggage looks simple and no different from a general luggage.

DETAILED DESCRIPTION OF THE INVENTION

Figure 1:
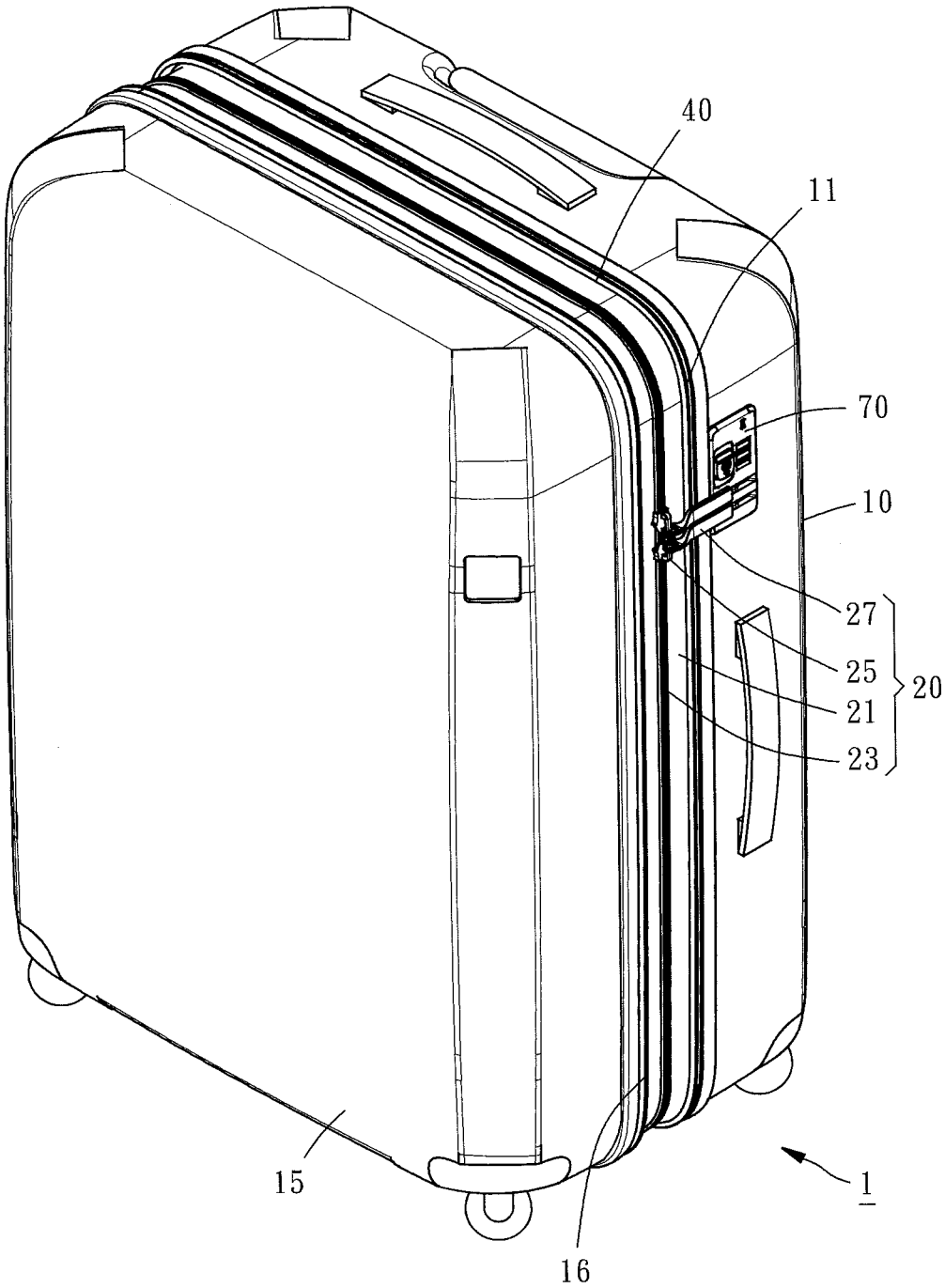
FIG. 1 is a perspective view of a luggage according to a first preferred embodiment of the present invention, which illustrates the luggage is closed by an inner zipper.
Figure 2:
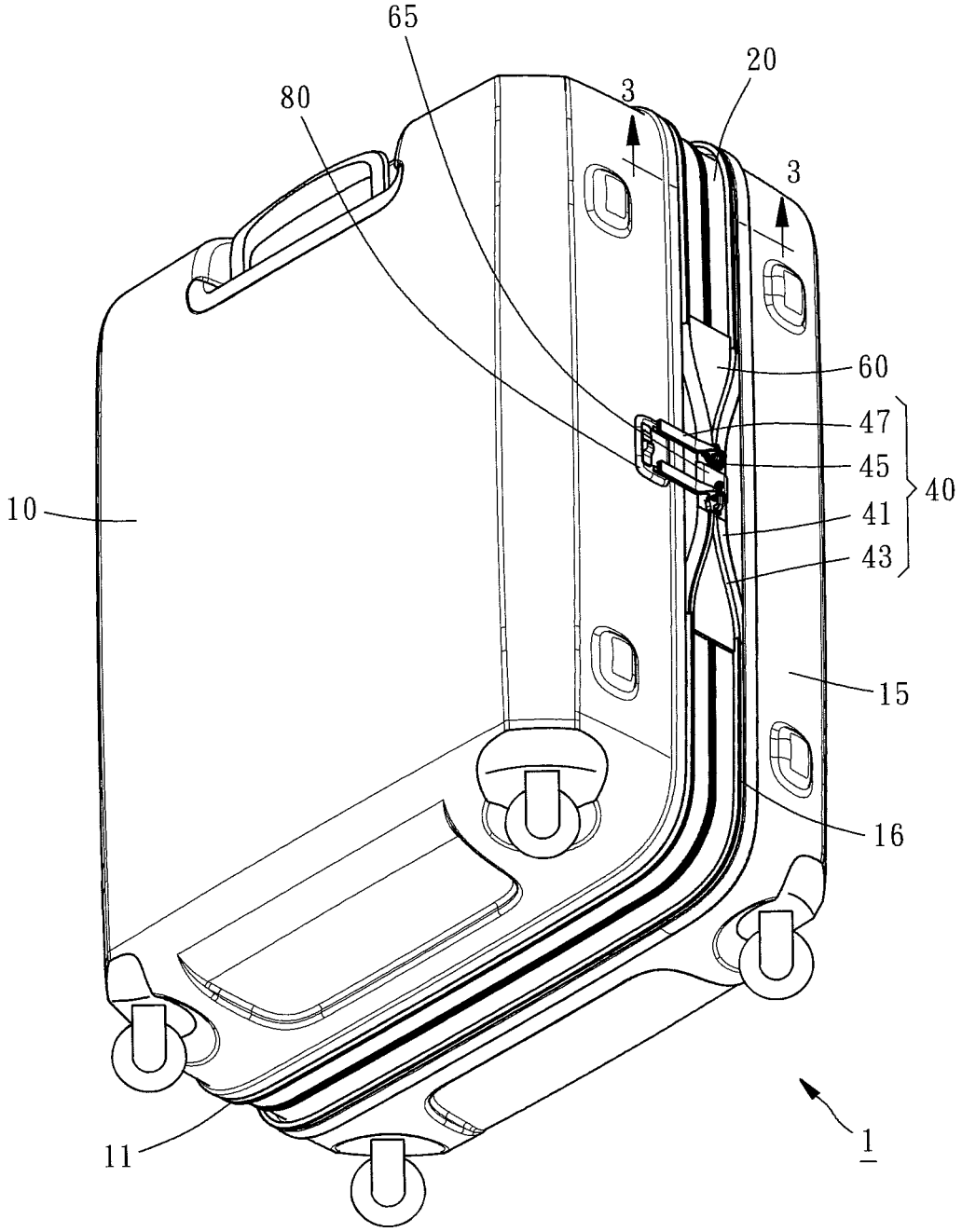
FIG. 2 is another perspective view of the luggage according to the first preferred embodiment of the present invention, which illustrates the luggage is closed by the inner zipper.

Referring to FIGS. 1 and 2 illustrating an extendable luggage 1, which comprises a first shell 10, a second shell 15, an inner zipper 20, an outer zipper 40, an inner strap 60, an outer strap 65, a main zipper lock 70 and a secondary zipper lock 80.

The first shell 10 has a first opening edge 11, and the second shell 15 has a second opening edge 16. The first and second shell 10, 15 is not limited to a hard shell made of metal, plastic, fiber reinforcement plastic, etc., a soft shell made of fabric, leather, etc., a combination of aforementioned shell or other shell made of plastic material.

Figure 3:
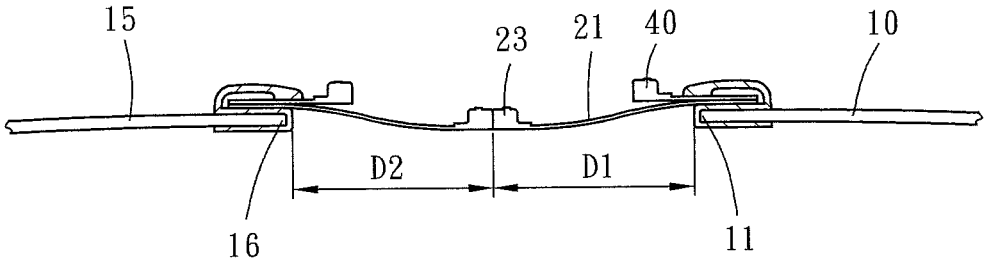
FIG. 3 is a sectional view of FIG. 2 along a direction 3-3, which illustrates the luggage is closed by the inner zipper.

The inner zipper 20 has two inner tapes 21 respectively disposed at the first opening edge 11 and the second opening edge 16, a plurality of inner teeth 23 disposed at two sides of the two inner tapes 21 away from the first and second opening edge 11, 16, two inner sliders 25 disposed at the inner teeth 23, and two inner pullers 27 disposed at the inner sliders 25. The inner sliders 25 is movable between two ends of the two inner tapes 21, so as to open or close the opposite inner teeth 23. Referring to FIG. 3, the inner teeth 23 are located at a first distance D1 away from the first opening edge 11 and a second distance D2 away from the second opening edge 16, and the first distance D1 is substantially equal to the second distance D2.

It should be noticed that, each of the inner tapes 21 is one piece in the present embodiment, however in the other embodiments, if the widths of the inner tapes 21 is not enough to be connected with the first and second opening edge 11, 16, two extended straps (not shown) may be provided to connect the inner tapes 21 with the first and second opening edge 11, 16.

Figure 4:
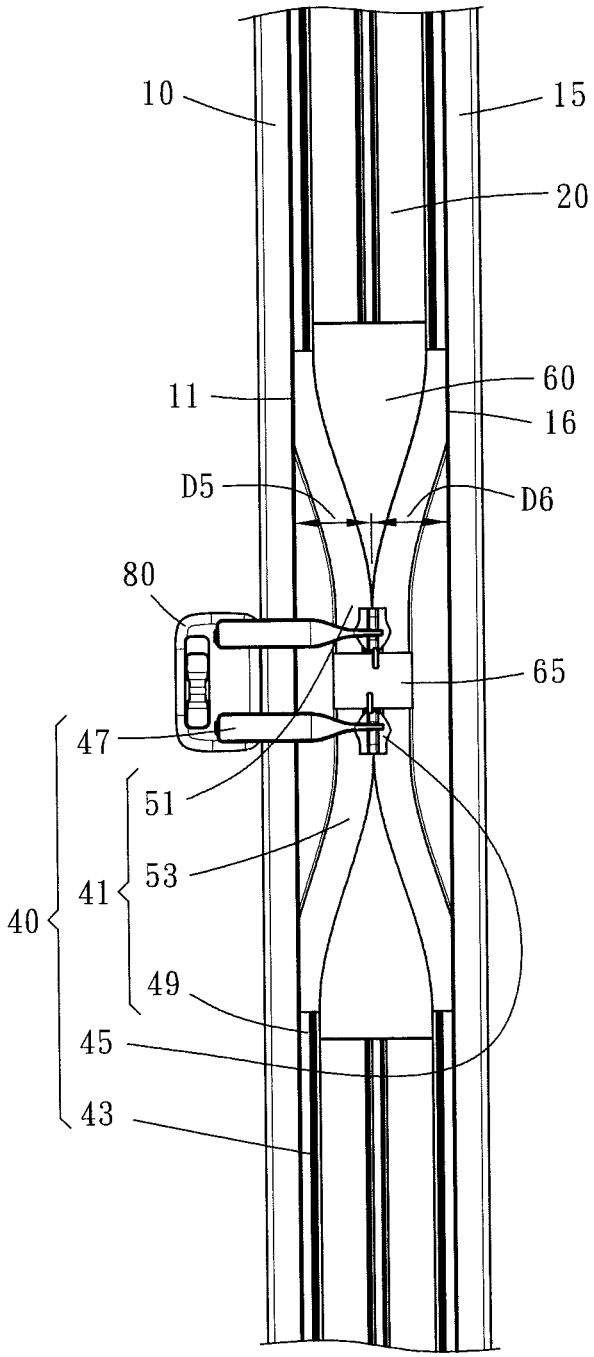
FIG. 4 is a partial side view of the luggage according to the first preferred embodiment of the present invention, which illustrates the luggage is closed by the inner zipper.
Figure 5:
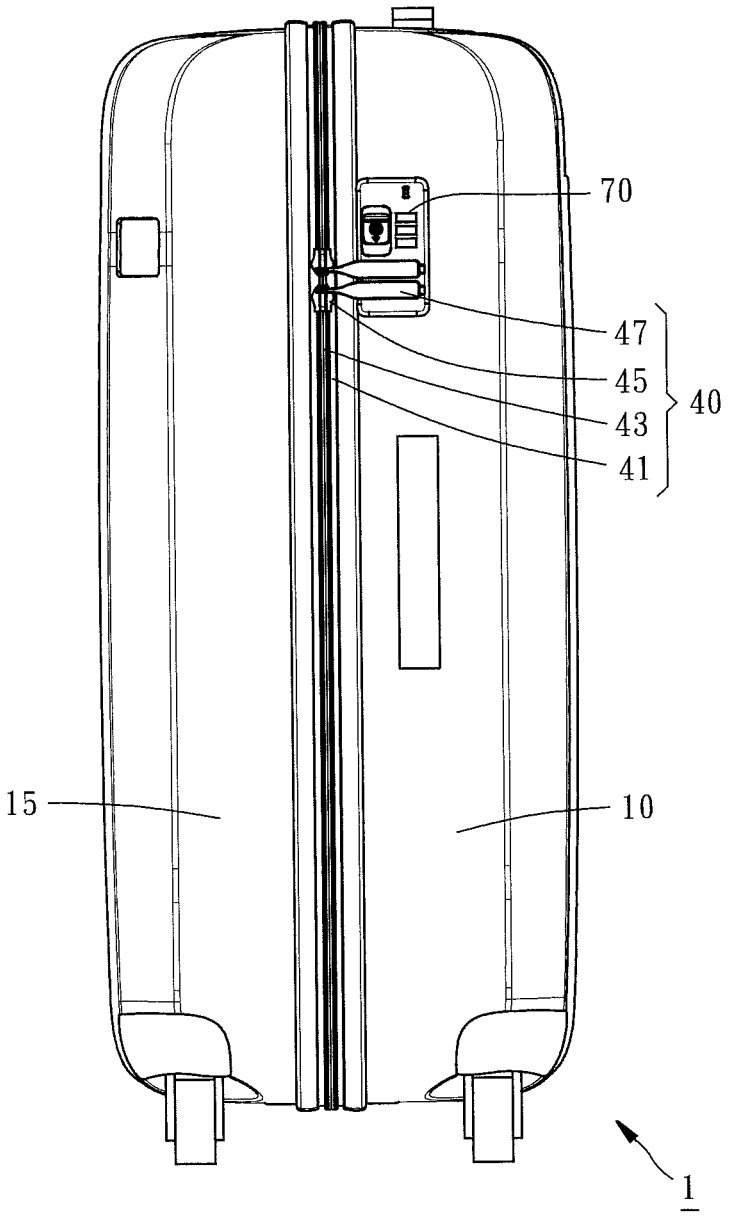
FIG. 5 is a side view of the luggage according to the first preferred embodiment of the present invention, which illustrates the luggage is closed by an outer zipper.
Figure 7:
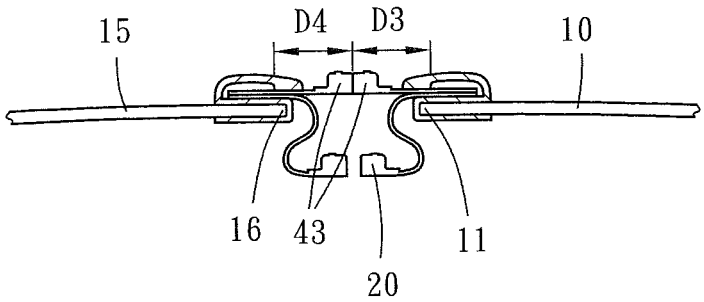
FIG. 7 is a sectional view of FIG. 6 along a direction 6-6, which illustrates the luggage is closed by the inner zipper.
Figure 8:
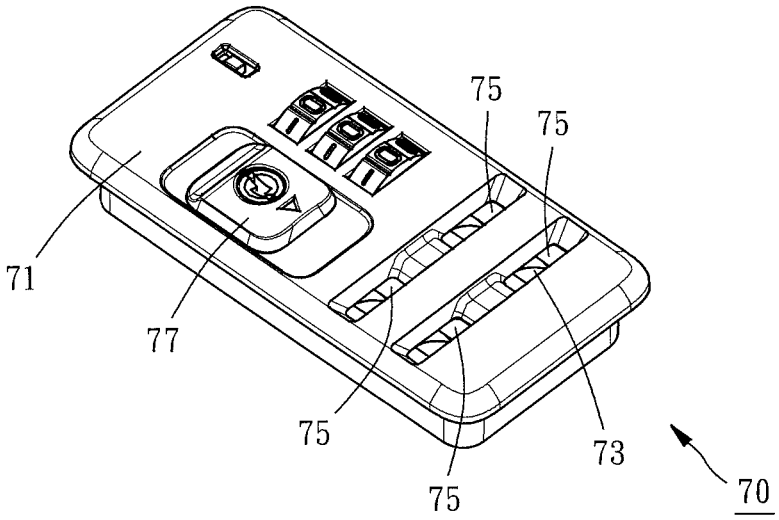
FIG. 8 is a perspective view of a main zipper lock according to the first preferred embodiment of the present invention.
Figure 9:
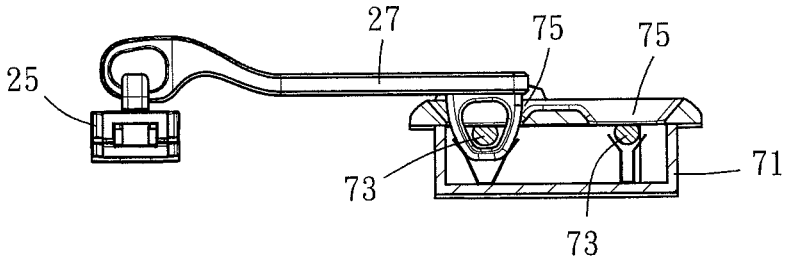
FIG. 9 is a perspective view of the main zipper lock and the inner zipper according to the first preferred embodiment of the present invention.
Figure 10:
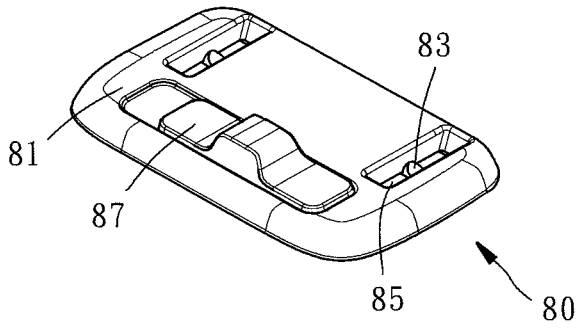
FIG. 10 is a perspective view of a secondary zipper lock according to the first preferred embodiment of the present invention.

Referring to FIGS. 4 and 5, the outer zipper 40 is located at outside of the inner zipper 20. The outer zipper 40 has two outer tapes 41, a plurality of outer teeth 43, two outer sliders 45 disposed at the outer teeth 43, and two outer pullers 47 disposed at the outer sliders 45. The outer sliders 45 is movable between two ends of the two outer tapes 41, so as to open or close the opposite outer teeth 43. Each of the outer tapes 41 has a straight section 49, a head section 51 extended from an end of the straight section 49 and not parallel to the straight section 49, and a tail section 53 extended from the other end of the straight section 49 and not parallel to the straight section 49. The two straight sections 49 are respectively disposed at the first and second opening edges 11, 16, the outer teeth 43 located at distal ends of the two head sections 51 and two tail sections 53 are closed and unable to be opened, it means that when two outer sliders 45 move to the distal ends of two head sections 51 and two tail sections 53, four connections from the head ends to the distal ends of the two head sections 51 and two tail sections 53 is inclined relative to the two straight sections 49 (as shown in FIG. 4). Referring to FIG. 7, the outer teeth 43 located at the two straight sections 49 are located at a third distance D3 away from the first opening edge 11, and the outer teeth 43 located at the two straight sections 49 are located at a fourth distance D4 away from the second opening edge 16. It should be noticed that, the third distance D3 is less than the first distance D1, the fourth distance D4 is less than the second distance D2, so that part of the two inner tapes 21, the two inner sliders 25 and the inner teeth 23 are exposed (as shown in FIGS. 1 and 2) when the two outer tapes 41 and the two inner tapes 21 are all extended. In the present embodiment, the third distance D3 is substantially equal to the fourth distance D4, it means that the two outer sliders 42 are located at the center between the first and second opening edges 11, 16, so that a user can move the two outer sliders 45 by the two outer pullers 47 with smoothness. However, in other embodiments, the distance D3 is different from the distance D4, but the two outer sliders 45 need to be still movable smoothly. Referring to FIG. 4, the outer teeth 43 located at the distal ends of the two head sections 51 and two tail sections 53 are located at a fifth distance D5 away from the first opening edge 11, the outer teeth 43 located at the distal ends of the two head sections 51 and two tail sections 53 are located at a sixth distance D6 away from the second opening edge 16, and the first, fifth and sixth distances D1, D5, D6 are substantially equal. Therefore, the distal ends of the two head sections 51 and the two tail sections 53 are located at the center of the inner strap 60, and the two outer sliders 45 can move between the two straight sections 49 and the distal ends of the two head and two tail sections 51, 53 successfully.

It should be noticed that, the aforementioned distances between the inner or outer teeth 23, 43 and the first or second edges 11, 16 are distances from the central boundaries of the closed inner or outer teeth 23, 43 to the first or second opening edge 11, 16. However, the aforementioned distances can be distances from one side of the inner or outer teeth 23, 43 connected with the inner or outer tape 21, 41 to the first or second opening edge 11, 16 or from the other side of the inner or outer teeth 23, 43 away from the inner or outer tape 21, 41 to the first or second opening edge 11, 16.

Referring to FIGS. 2 and 4, two sides of the inner strap 60 are respectively connected with the first and second opening edges 11, 16. The inner strap 60 is connected with two ends of the inner zipper 20, so that the inner zipper 20 and the inner strap 60 form a complete round. In the present embodiment, the two head sections 51 and the two tail sections 53 of the two outer tapes 41 can be stitched with the inner strap 60. In addition, the inner zipper 20 is disposed round four sides of the luggage 1, and the inner strap 60 is merely disposed at one side of the luggage 1, so that the inner strap 60 can be as a reference side for opening or closing the first and second shells 10, 15. However, in other embodiments, the length of the inner strap 60 can be lengthened, so that the inner zipper 20 is disposed round three sides of the luggage 1, but the first and second shells 10, 15 need to be extendable and able to be closed with success.

Referring to FIGS. 2 and 4, the outer strap 65 is disposed at outside of the inner strap 60 and connected with the two ends of the outer zipper 40, so that the outer zipper 40 and the outer strap 65 form a complete round. In the present embodiment, the length of the outer strap 65 is less than the length of the inner strap 60, however, the length of the inner strap 60 can be modified in moderation. It should be noticed that, the outer strap 65 is used for fastening the outer zipper 40 and covering bottom stops of the outer strap 40 (not shown). However, in other embodiments, the outer strap 65 can be omitted, but the two ends of the outer zipper 40 should be actually fixed on the inner strap 60. In addition, two sides of the outer strap 65 can be connected with the first and second opening edges 11, 16, so as to fasten the outer zipper 40 more steady.

Referring to FIGS. 1, 5, 8 and 9, the main zipper lock 70 has a main body 71 disposed at the first shell 10, a main locking mechanism 73 disposed at the main body 71 and locked therein with the two inner pullers 27 and two outer pullers 47, four main slots 75 disposed at the main body 71 and inserted therein with the two inner pullers 27 and two outer pullers 47, and a main controlling member 77 disposed at the main body 71 and controlling locking or unlocking of the main locking mechanism 73. In the present embodiment, the main controlling member 77 ca be pulled forward or back to make the main locking mechanism 73 lock the two inner pullers 27 and two outer pullers 47 inserted into the four main slots 75 or release a lock state. In the present embodiment, the forms of the two inner pullers 27 and two outer pullers 47 are the same in the present embodiment, two said main slots 75 are nearer than the other two main slots 75 to the inner zipper 20, so that the two inner pullers 27 is insertable into the nearer of the main slots 75, and the two outer pullers 49 is insertable into the further of the main slots 75, it means that the two inner pullers 27 and two outer pullers 47 are all insertable into the four main slots 75. It should be noticed that, the main zipper lock 70 is used for preventing someone else from opening the inner and outer zippers 20, 40 arbitrarily. However, in other embodiments, the main zipper lock 70 can be omitted, and the luggage 1 is still extendable. In addition, the main zipper lock 70 can be disposed at the second shell 15, and the disposed position of the main zipper lock 70 may be not located at the side of the luggage 1 opposite to the inner strap 60 but may be near to the outer zipper 40.

Referring to FIGS. 2, 4, 6 and 10, the secondary zipper lock 80 has a secondary body 81 disposed at the first shell 10 and adjacent to the outer strap 65, a secondary locking mechanism 83 disposed at the secondary body 81 and locked therein with the two outer pullers 47, two secondary slots 85 disposed at the secondary body 81 and inserted therein with the two outer pullers 47, and a secondary controlling member 87 disposed at the secondary body 81 and controlling locking or unlocking of the secondary locking mechanism 83. In the present embodiment, the secondary controlling member 87 ca be pulled forward or back to make the secondary locking mechanism 83 lock the two outer pullers 47 inserted into the two secondary slots 85 or release a lock state. It should be noticed that, the secondary zipper lock 80 is used for fastening the two outer pullers 47 when the two outer sliders 45 move to the two ends of the outer zipper 40, so that the two outer pullers 47 would not be swingable. However, in other embodiments, the secondary zipper lock 80 can be omitted, and the luggage 1 is still extendable. In addition, the secondary zipper lock 80 can be disposed at the second shell 15, and the secondary zipper lock 80 should be near to the distal ends of the two head sections 51 and two tail sections 53.

Referring to FIGS. 2 and 4, when a user pulls the two outer pullers 47 and moves the two outer pullers 47 from the distal ends of the two head sections 51 and two tail sections 53 toward opposite direction each other, the first and second shells 10, 15 would be pulled close to each other until the two outer pullers 45 move to the position adjacent to the two straight sections 49, and the distance between the first and second shells 10, 15 is substantially equal to the sum of the third and fourth distances D3, D4 (as show in FIG. 7). If the user continues to pull the two outer sliders 45 and two outer pullers 47 to move to the position adjacent to the main zipper lock 70, then the two outer pullers 47 can be locked with the main zipper lock 70 (as shown in FIG. 5). When the two outer zippers 40 is completely closed, only the outer zippers 40 can be seen by the user, and the inner zipper 20 can be covered. Therefore, when the outer zipper 40 are opened and the two outer pullers 45 move to the side of the luggage 1 disposed with the inner strap 60, the first shell 10 would be swingable relative to the second shell 15, and the luggage 1 can be opened completely.

On the other hand, if too much goods are accommodated in the luggage 1 and a user can not close the luggage 1 by the outer zipper 40, referring to FIGS. 1 and 2, the user can pull the two inner pullers 27 and move the two inner sliders 25 from the distal ends of the two inner tapes 21 toward opposite direction each other (the two outer sliders 45 should be located at the distal ends of the two head sections 51 and two tail sections 53), meanwhile, the distance between the first and second shells 10, 15 may be equal to the sum of the first and second distances D1, D2 (as shown in FIG. 3). By comparison with only closing the outer zipper 40, the accommodating space of the luggage 1 when only closing the inner zipper 20 is larger, so that more goods can be accommodated in the luggage 1. In addition, the two inner sliders 25 is disposed at the center of the first and second opening edges 11, 16, the first distance D1 is greater than the third distance D3 and the second distance D2 is greater than the fourth distance D4, so that the two inner pullers 27 would not be interfered with the outer zipper 40 or the first and second opening edges 11, 16 when being pulled. It should be noticed that, in other embodiments, the first and second distances D1, D2 may be not equal, but the two outer pullers 45 still move successfully.

Figure 6:
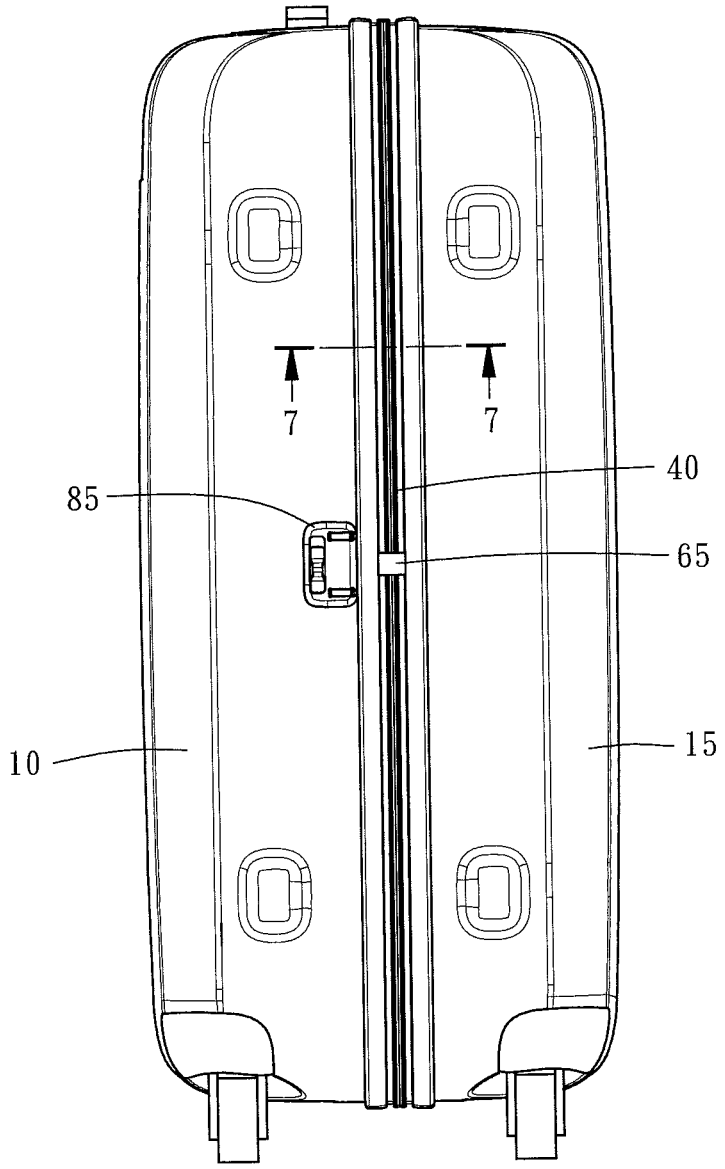
FIG. 6 is another side view of the luggage according to the first preferred embodiment of the present invention, which illustrates the luggage is closed by the outer zipper.

By using the aforementioned structure, the luggage 1 may have two capacities: if the inner zipper 20 is opened and the luggage 1 is closed or opened by the outer zipper 40, the luggage 1 has a normal capacity (as shown in FIGS. 5 and 6); if the outer zipper 40 is opened and the luggage 1 is closed or opened by the inner zipper 20, the luggage 1 is extendable and has a lager capacity (as shown in FIGS. 1 and 2). In addition, when the luggage 1 is closed by both inner and outer zippers 20, 40, the luggage 1 can have a double anti-theft protection, so that someone else cannot cut both inner and outer zippers 20, 40 by a sharp object at the same time. On the other hand, when one of the inner and outer zippers 20, 40 is damaged, the luggage 1 still can be opened or closed by the other one operated normally. In addition, it is very convenient for a user to adjust the accommodated space by pulling the inner and outer zippers 20, 40, and the luggage 1 looks simple after being closed by the inner and outer zippers 20, 40.

Figure 11:
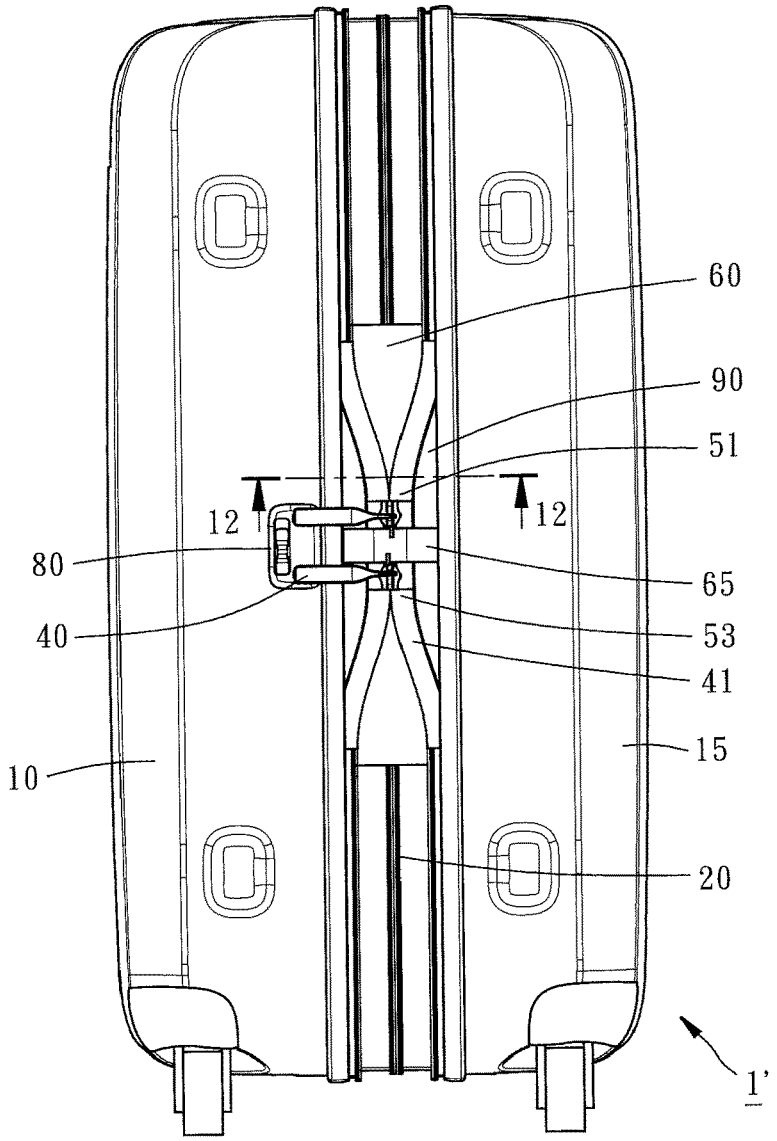
FIG. 11 is a side view of a luggage according to a second preferred embodiment of the present invention.
Figure 12:
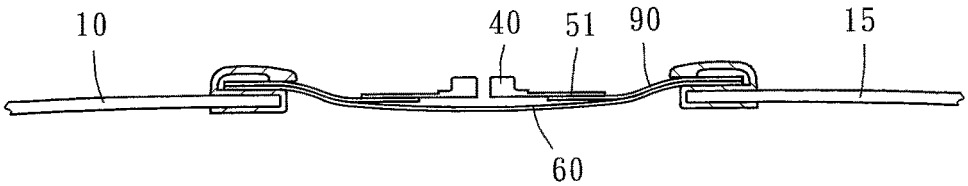
FIG. 12 is a sectional view of FIG. 11 along a direction 12-12.

Based on the spirit of the present invention, the structure of the luggage 1 can be modified. For example, the head sections 51 and tail section 53 of the outer tapes 41 are disposed at the inner strap 60 in the first preferred embodiment, but the disposed manner of the two head sections 51 and two tail sections 53 can be modified. Referring to FIGS. 11 and 12 illustrating a second preferred embodiment, differences between the second and first preferred embodiments are, the luggage 1' further has two fixed straps 90, one side of each of which is connected with the two head sections 51 and two tail sections 53, and the other side of each of which is connected with the first or second opening edge 11, 16, so that the two head sections 51 and two tail sections 53 would not need to be stitched with the inner strap 60. In another embodiment, the widths of the head sections 51 and tail sections 53 of the two outer tapes 41 may be different with the widths of the straight sections 49, and the head sections 51 and tail sections 53 can be directly connected with the first and second opened edges 11, 16 (not shown). On the other hand, the inner zipper 20 with two said inner sliders 25 and two said inner pullers 27 and the outer zipper 40 with two said outer sliders 45 and two said outer puller 47 would let a user open or close the luggage 1 with convenience. However, in other embodiments, the inner zipper 20 may have one said inner slider 25 and one said inner puller 27, and the outer zipper 40 may have one said outer slider 45 and one said outer puller 47, but the numbers of the main and secondary slots 75, 85 and the structures of the main and secondary locking mechanisms 75, 85 should be modified correspondingly.

The above description represents merely the preferred embodiment of the present invention, without any intention to limit the scope of the present invention. The simple variations and modifications not to be regarded as a departure from the spirit of the invention are intended to be included within the scope of the following claims.

What is claimed is:

1. An extendable luggage, comprising:

a first shell, having a first opening edge;

a second shell, having a second opening edge;

an inner zipper, having two inner tapes respectively disposed at the first and second opening edges, a plurality of inner teeth disposed at the two inner tapes, at least one inner slider disposed at the inner teeth, and at least one inner puller disposed at the inner slider; the inner slider being used for opening or closing an opposite inner teeth;

wherein the inner teeth are located at a first distance away from the first opening edge and a second distance away from the second opening edge;

an outer zipper, having two outer tapes, a plurality of outer teeth disposed at the two outer tapes, at least one outer slider disposed at the outer teeth, and at least one outer puller disposed at the outer slider; the outer slider being used for opening or closing an opposite outer teeth; each of the outer tapes having a straight section, a head section extended from an end of the straight section and not parallel to the straight section, and a tail section extended from an other end of the straight section and not parallel to the straight section;

wherein the two straight sections are respectively disposed at the first and second opening edges, the outer teeth located at distal ends of the two head sections and two tail sections are closed and unable to be opened, the outer teeth located at the two straight sections are located at a third distance away from the first opening edge, the outer teeth located at the two straight sections are located at a fourth distance away from the second opening edge, the third distance is less than the first distance, the fourth distance is less than the second distance; the outer zipper is located outside of the inner zipper; and an inner strap, two sides of which are respectively connected with the first and second opening edges; the inner strap being connected with two ends of the inner zipper, so that the inner zipper and the inner strap form a complete round.

2. The extendable luggage as claimed in claim 1, wherein the two head sections and two tail sections are disposed at the inner strap.

3. The extendable luggage as claimed in claim 1, further comprising two fixed straps, one side of each of which is connected with the two head sections and two tail sections, and the other side of each of which is connected with the first or second opening edge.

4. The extendable luggage as claimed in claim 1, wherein the first distance is substantially equal to the second distance.

5. The extendable luggage as claimed in claim 4, wherein the outer teeth located at the distal ends of the two head sections are located at a fifth distance away from the first opening edge, the outer teeth located at the distal ends of the two head sections are located at a sixth distance away from the second opening edge; the first, fifth and sixth distances are substantially equal.

6. The extendable luggage as claimed in claim 1, wherein the third distance is substantially equal to the fourth distance.

7. The extendable luggage as claimed in claim 1, further comprising an outer strap disposed at the inner strap and connected with two ends of the outer zipper, so that the outer zipper and the outer strap form a complete round.

8. The extendable luggage as claimed in claim 7, wherein a length of the outer strap is less than a length of the inner strap.

9. The extendable luggage as claimed in claim 7, wherein two sides of the outer strap are connected with the first and second opening edges, respectively.

10. The extendable luggage as claimed in claim 1, wherein the inner zipper has two said inner sliders and two said inner pullers, the outer zipper has two said outer sliders and two said outer pullers; the extendable luggage further comprises a main zipper lock, the main zipper lock has a main body disposed at the first shell, a main locking mechanism disposed at the main body and locked therein with the two inner pullers and two outer pullers, four main slots disposed at the main body and inserted therein with the two inner pullers and two outer pullers, and a main controlling member disposed at the main body and controlling locking or unlocking of the main locking mechanism.

11. The extendable luggage as claimed in claim 1, wherein the outer zipper has two said outer sliders and two said outer pullers; the extendable luggage further comprises a secondary zipper lock, the secondary zipper lock has a secondary body disposed at the first shell, a secondary locking mechanism disposed at the secondary body and locked therein with the two outer pullers, two secondary slots disposed at the secondary body and inserted therein with the two outer pullers, and a secondary controlling member disposed at the secondary body and controlling locking or unlocking of the secondary locking mechanism.

* * * * *